United States Patent [19]

Mulder et al.

[11] Patent Number: 4,485,645

[45] Date of Patent: Dec. 4, 1984

[54] FOREIGN OBJECTS TRAP FOR AUTOMATIC WASHER

[75] Inventors: James R. Mulder, Berrien Township, Berrien County; John W. Pielemeier, St. Joseph; Joel M. Snider, Lincoln Township, Berrien County, all of Mich.

[73] Assignee: Whirlpool Corporation, Benton Harbor, Mich.

[21] Appl. No.: 430,953

[22] Filed: Sep. 30, 1982

[51] Int. Cl.[3] ..... D06F 39/10

[52] U.S. Cl. ..... 68/18 F; 68/208; 134/104; 210/167; 210/498

[58] Field of Search ..... 68/18 F, 208, 18 FA; 134/104, 111; 210/167, 498, 532.1

[56] References Cited

U.S. PATENT DOCUMENTS

| | | | |
|---|---|---|---|
| 1,105,045 | 7/1914 | Shipherd | 134/111 |
| 1,215,267 | 2/1917 | Gunst . | |
| 1,233,272 | 7/1917 | Hotchkiss | 210/498 X |
| 1,254,025 | 1/1918 | Buxton . | |
| 1,382,992 | 6/1921 | Lombard | 68/208 X |
| 2,166,279 | 7/1939 | Barwick | 210/532.1 X |
| 2,583,422 | 1/1952 | Haddon . | |
| 2,894,631 | 7/1959 | Levit . | |
| 2,919,568 | 1/1960 | Stone . | |
| 3,006,477 | 10/1961 | Karecki . | |
| 3,236,386 | 2/1966 | Salisbury . | |
| 3,352,130 | 11/1967 | Landwier | 68/18 F |
| 3,590,606 | 7/1971 | Takeyama . | |
| 3,598,651 | 8/1971 | Valavaara | 134/104 X |
| 3,727,435 | 4/1973 | Menk | 134/111 X |
| 3,910,076 | 10/1975 | Ruble | 68/18 F |
| 4,003,225 | 1/1977 | Worst | 68/18 FA |
| 4,125,003 | 11/1978 | Wasemann | 68/208 |

FOREIGN PATENT DOCUMENTS

| | | | |
|---|---|---|---|
| 1503764 | 5/1969 | Fed. Rep. of Germany | 134/104 |
| 2708663 | 8/1978 | Fed. Rep. of Germany | 68/208 |

*Primary Examiner*—Philip R. Coe
*Assistant Examiner*—Frankie L. Stinson
*Attorney, Agent, or Firm*—Hill, Van Santen, Steadman & Simpson

[57] ABSTRACT

A foreign objects trap for an automobile washer is provided in the wash liquid flow path just upstream of the pump which has a settling chamber and a separator plate to trap foreign objects. The separator plate has irregularly shaped tubes therethrough which, in conjunction with a closely spaced wall of the trap housing, prevent passage of lighter than water objects. A lower portion of the housing is removable for cleaning and is transparent for visual inspection.

11 Claims, 4 Drawing Figures

FOREIGN OBJECTS TRAP FOR AUTOMATIC WASHER

BACKGROUND OF THE INVENTION

1. Field of the Invention

The present invention relates to an apparatus for filtering particles from a liquid and more particularly to an apparatus for trapping large foreign objects in a wash liquid in an automatic washer.

2. Description of the Prior Art

Automatic clothes washing machines are provided with a pump which among other things recirculates wash liquid within the wash tub. As the wash liquid is recirculated throughout the clothes load, foreign objects such as coins, buttons, bobby pins, toothpicks and other similar objects become entrained in the wash liquid and are carried toward the pump. It is necessary to intercept and trap these foreign objects prior to their reaching the pump so that they will not cause damage to the pump. Various attempts have been made to filter out these foreign objects which can range in size, shape and density from heavy disc shaped objects such as coins and buttons to floatable cylindrical rod shaped objects such as toothpicks. This wide range of sizes, shapes and densities presents a particular filtering problem in automatic washers which the present invention overcomes.

Various means have been employed between the washing vessel and pump to intercept foreign objects, among them being (a) gravity type traps which provide a low water velocity region for heavier than water objects to settle out and collect, (b) grid types, and (c) labyrinth types. All of the above types have various advantages and drawbacks. Type (a), in principle, will only intercept heavier than water objects, while objects of wood or light plastic such as toothpicks will pass. An advantage is that the objects trapped will not typically accumulate lint, partly because they are out of the main water stream and partly because they are free to shift position easily. This type also requires several inches of vertical space which may or may not be readily available. Type (b), can be made to intercept objects as small as desired and of any material, but will typically accumulate lint on both the grid and the objects intercepted. Eventually the accumulation of lint will restrict waterflow through the system unless removed. Removal of the lint is a nuisance and is dependent on the vigilance of the operator. Type (c), can be made to intercept objects of almost any size, shape and material. It can also be made to pass lint, at least when free of foreign objects. However, the accumulated foreign objects tend to take on the characteristics of a grid and collect lint themselves. This is especially true if the objects are held in a region of high water velocity and restricted freedom to move about and thereby, perhaps, release their lint.

U.S. Pat. No. 2,919,568 discloses a straining device which is adapted to prevent the passage of long narrow objects such as nails, matches, paper clips and bobby pins which comprises a plate having circular perforations therein which is positioned fairly close to the bottom wall of the tub and has the perforations spaced laterally from the drain opening such that long cyindrical shaped objects are unable to pass through the perforations to the drain opening.

U.S. Pat. No. 3,006,477 discloses a filter which utilizes a settling chamber and two annular outlet passageways to remove lint and heavy articles from the wash water.

U.S. Pat. No. 3,236,386 discloses a foreign articles trap wherein wash liquid is directed through an annular opening and through two 180 degree turns and which also employs an annular settling chamber.

U.S. Pat. No. 3,590,606 discloses a tube in the foreign objects trap arranged with the outlet spaced between the top and the bottom of the outer tube such that heavier than water objects settle to the bottom of the tube and lighter than water objects float to the top of the outer tube while the washing liquid passes out the outlet opening.

U.S. Pat. No. 1,254,025 discloses a filter screen for use in removing sand, gravel and other sediment from water lines in which a cylindrical or flat circular screen is used which has perforations therethrough with outwardly extending fingers or projections which are used to protect the perforations from clogging.

U.S. Pat. No. 2,533,422 discloses a house gutter screen which is used to prevent leaves and twigs from collecting in house gutters in which a plate is used to cover the gutters which has a plurality of domes embossed in the plate having side openings forming drain openings. The domes are used to hold flat solid objects such as leaves away from the drain openings so that water can drain easily into the gutters while the leaves and other debris are kept out of the gutters.

SUMMARY OF THE INVENTION

The present invention provides for a foreign objects trap which is to be used in an automatic washer to prevent foreign objects from entering the wash container inlet port along with the wash liquid. The foreign objects trap does permit lint to pass through and not accumulate in the trap. The trap utilizes a settling chamber in conjunction with a grid type plate having irregular shaped openings therethrough closely associated with the walls of the trap such that foreign objects are prevented from passing through the grid but lint is allowed to pass without accumulating.

DESCRIPTION OF THE PREFERRED EMBODIMENTS

Figure 1:
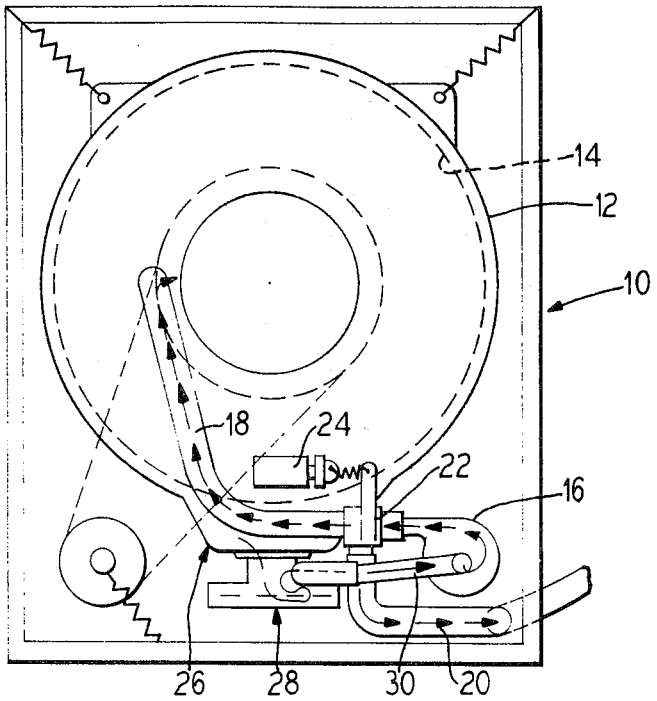
FIG. 1 is a schematic view of a horizontal axis washer and showing the path of wash liquid from the sump through the pump to recirculate or to drain.

In FIG. 1 there is shown an automatic washing machine 10 of the horizontal axis type, having a cylindrical imperforate tub member 12 carrying a perforate basket 14 therein. A pump 16 is provided to recirculate wash liquid through a return conduit 18 or to pump wash liquid to a waste drain through a conduit 20 depending on the position of a valve 22 which is automatically controlled by a solenoid 24. The wash liquid collects in a sump area 26 at the bottom of the tub 12 and passes through a foreign objects trap shown generally at 28 prior to entering the pump 16 through an inlet conduit 30.

Figure 2:
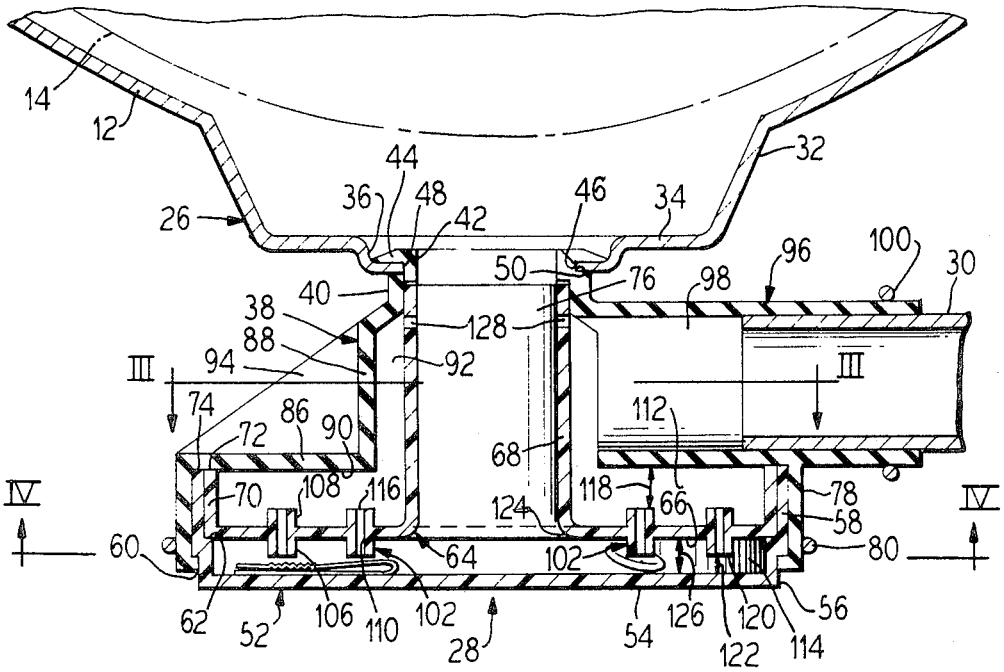
FIG. 2 is a partial side sectional view of the foreign objects trap of the present invention.

As seen in greater detail in FIG. 2, the sump area 26 of the tub 12 is comprised of a sloped side wall portion 32 which is integrally connected at its top with the imperforate tub 12 and which has a horizontal bottom wall 34 with a central well 36 therein.

The foreign objects trap 28 is comprised of an upper housing 38 preferably formed of an elastomeric material and which has at an upper end a cylindrical neck portion 40 with a circular opening 42 therethrough and having a flanged end 44. The well portion 36 of sump 26 has a circular opening 46 therethrough and the neck portion 40 of the upper housing 38 is sized to be received in the well opening 46 such that the flanged area 44 covers a portion of the wall of the well 36. An edge 48 of the wall forming the opening 46 is received in a groove 50 just below the flanged top 44 such that a water tight seal is effected between the upper housing 38 and the well 36 of the sump 26.

Figure 4:
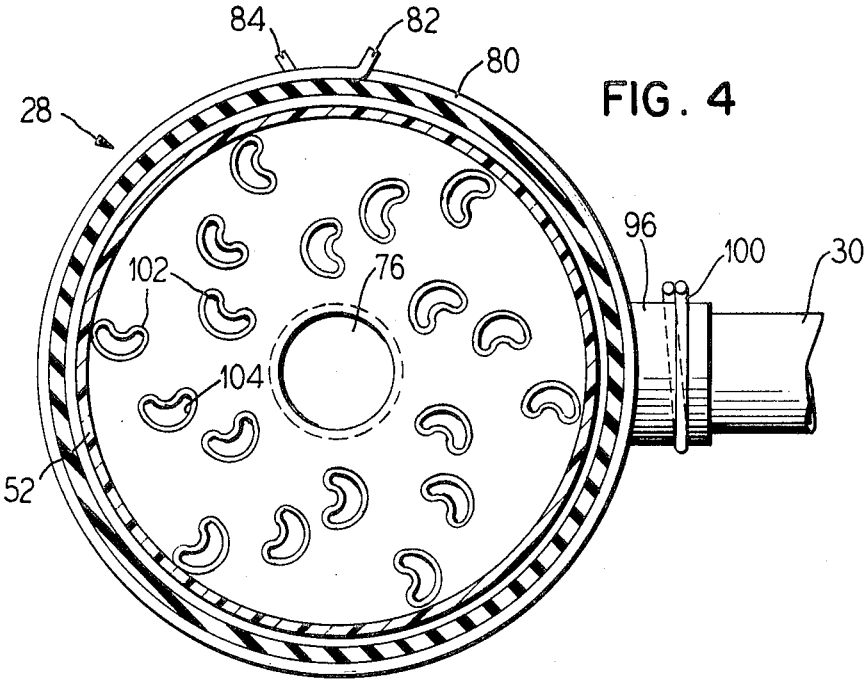
FIG. 4 is a bottom sectional view of the foreign objects trap taken generally along the lines IV—IV of FIG. 2.

A lower housing 52 is provided which is constructed of a relatively rigid material and is seen in FIGS. 2 and 4 as being of a generally cylindrical shape. The lower housing 52 has a circular flat bottom wall 54 and a first cylindrical side wall 56 formed at right angles to the bottom wall and projecting from the circumference of the bottom wall. A second cylindrical wall portion 58 is formed integrally with the first wall portion 56 but projects slightly radially outwardly in a stepped manner as seen at 60 thereby providing a ledge surface 62 around the inner circumference of the walls 56, 58.

A separator plate or baffle 64 comprises a generally circularly shaped plate 66 with a central tubular portion 68 projecting upwardly from the plate 66. A cylindrical wall 70 is formed on the outer circumference of the circular plate 66 and is sized to seat in the ledge area 62 of walls 56 and 58. Wall 70 has a height such that a top end 72 is coplanar with a top end 74 of wall 58. The central tubular portion 68 of separator plate 64 is sized to extend up into and be snugly received by neck portion 40 of the upper housing 38. The tubular portion 68 has an open passage 76 therethrough which is of the same size as opening 42 in the neck portion 40 of upper housing 38.

Figure 3:
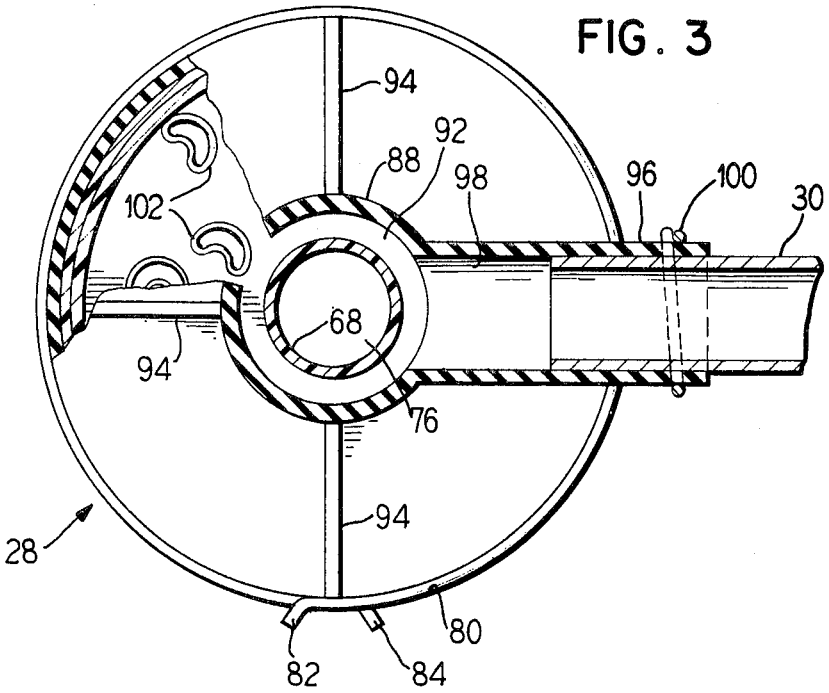
FIG. 3 is a top sectional view of the foreign objects trap partially cut away and taken generally along the lines III—III of FIG. 2.

The upper housing 38 has a downwardly extending cylindrical flange 78 which is sized to snugly receive wall portion 58 of the lower housing 52. A circular clamp 80 encircles the flange wall 78 and thereby holds the lower housing 52 and separator plate 64 in fixed relationship with the upper housing 38. The pliant nature of the elastomeric flange 78 provides an effective water tight seal between the upper housing 38 and lower housing 52 when the circular clamp 80 is secured in place. As seen in FIGS. 3 and 4 ends 82 and 84 of circular clamp 80 are turned outwardly so that the two ends can be manually squeezed together thereby loosening circular clamp 80 to facilitate removal of the lower housing 52 from the upper housing 38.

The upper housing 38 has a generally circular horizontally disposed wall portion 86 which is integrally connected at its outer circumference with flange 78 and which extends radially inwardly to a tubular vertically aligned wall portion 88. The upper surfaces 72 and 74 of walls 70 and 58 abut against a lower surface 90 of circular wall 86 such that the circular plate 66 of separator plate 64 is retained in a specific spaced relationship from the lower wall 54 of lower member 52 as defined by the height of the ledge 62 and from the circular wall 86 of the upper housing 38 as defined by the height of the wall 70.

The tubular wall 88 of upper housing 38 is spaced radially outwardly from the tubular wall 68 of the separator plate 64 so as to provide an annular space 92 between the tubular walls 68 and 88. Extending between walls 86 and 88 of upper housing 38 are a plurality of triangularly shaped struts 94 which are utilized to retain the perpendicular relationship between walls 86 and 88.

Upper housing 38 additionally has a horizontally disposed tubular extension wall 96 which projects radially outwardly from the annular space 92 and has an interior passage 98 which communicates with the annular space 92. The conduit 30 which communicates with the inlet port of the pump 16 is snugly received in passage 98 and a second circular clip 100 is used to provide a water tight seal between tubular wall 96 and conduit 30.

The circular portion 66 of separator plate 64 is provided with a plurality of irregularly shaped tubes 102 such as the C-shaped tubes seen in FIGS. 3 and 4. The tubes 102 are of a width and shape such that coins and buttons will not pass therethrough. Curvature of the tubes is critical, especially in blockage of plate shaped objects such as coins. Openings 104 in the tubes 102 form slots which should neither be so narrow that they are readily bridged by lint nor so near together that strands of lint will wrap around the intervening material.

The tubes 102 have boss portions 106 and 108 extending below and above, respectively, the plate 66 of the separator 64 such that there is a passage 110 through the interior of the tubes. The tubes 102 are positioned on the plate 66 such that the passage 110 communicates with a region 112 above plate 66 of separator plate 64 and below wall 86 of upper housing 38 at a top end and a region 114 comprising a settling chamber which is below the circular plate 66 of separator plate 64 and above bottom wall 54 of lower housing 52. A top end 116 of tubes 102 is spaced a short distance 118 below the bottom surface 90 of wall 86 and a bottom end 120 of tubes 102 is spaced a short distance 122 above wall 54 such that elongated objects such as toothpicks cannot enter passages 110 from space 114.

In operation, the device functions as follows: whether during the recirculation of the wash liquid for wash purposes or during machine drainage, wash liquid passes from the sump area 26 of the washer tub 12 into the passageway 76 within the foreign objects trap which communicates with the well 36 of the sump 26, and spreads out into the region 114 below the plate 66 of the separator 64 where heavy objects settle out of the flow. The wash liquid then passes upward through the tubes 102, collects in annular area 92 and then passes to the pump through the passageway 98 and conduit 30. Because the region 114 below the collector plate 64 is of greater volume than the opening 42, water velocity drops in region 114 allowing heavier than water objects to drop to the bottom of the lower housing 52 and usually stay there. The tubes 102 are of a width and shape such that coins and buttons will not pass. Curvature of the tubes is critical, especially in blockage of plate shaped objects.

Certain relationships exist between the size of the spaces 118, 122 between the end of the tubes 102 and the walls 86 and 54, the width of the tubes, the length of the tubes, and the radius of curvature of the tube openings. As the length of the tubes becomes greater and as the width, radius and distance from the tubes to the walls become smaller, the length of a rod type object that the device will pass becomes smaller. Therefore it is possible to tailor the design to block objects greater than some selected length. However, trade-offs exist related to the volume of region 114 to store objects, and open area of the tubes to pass water and lint. Also, the distance 118 must be greater than the distance 122 so that objects which can pass into a tube can pass out into region 112. Otherwise, objects might become permanently stuck in the tubes and become lint catchers.

The relationship between the diameter of the opening 42, the opening 124 at the bottom of the cylindrical wall 68, and the distance 126 between the circular plate 66 and the bottom wall 54 should be such that rod shaped objects up to about 60 millimeters long can pass from opening 42 and lie flat on the bottom of the lower housing 52. Otherwise, these objects can become lint collectors.

While lighter than water objects such as toothpicks may temporarily position themselves across a tube opening while wash liquid is flowing steadily through the system, they will immediately shift when the pump loses prime or stops. This action will tend to release any lint that has become entangled with the rod shaped object. Similarly, heavy objects that have settled in the bottom are free to shift around, by virtue of the size of region 114, and thereby release lint. Bleed holes 128 in the tubular wall 68 are necessary to let air escape from the pump.

Diameter and depth of the region 114 are visualized as great enough that the device would not require emptying in the normal machine life. Likewise, since the device offers no point to snag and hold lint, there is not expected to be a progressive lint accumulation which would develop. To the contrary, should lint accumulate in the area 114 due to one or several successive very linty wash loads, this accumulation will break up and dissipate over the course of several subsequent more normally linty loads. However, should area 114 become clogged, the device permits relatively easy cleaning by removing circular clamp 80 and pulling the lower housing 52 out of the upper housing 38. The lower housing 52 may be made of a transparent material such as styrene acrylonitrile to facilitate observation of the condition of the trap by a service technician. The foreign objects trap will also serve as a water trap to block pump noise from reaching the tank when the pump loses prime.

The embodiments of the invention in which an exclusive property or privilege is claimed are defined as follows:

1. In an automatic washer having wash liquid recirculation and drain means, an improved foreign objects trap comprising:

a housing having an inlet and an outlet;

baffle means between said inlet and said outlet, said baffle means including a plurality of tubes extending therethrough, said tubes having arcuate shaped openings and unrestricted flow passages therethrough;

said inlet being arranged to communicate with an underside of said baffle means to trap floating objects beneath said baffle means, and said housing defining a settling chamber beneath said baffle means, whereby heavier than water objects are trapped beneath said baffle means.

2. In an automatic washer having wash liquid drain means, an improved foreign objects trap comprising, a housing having an inlet and an outlet;

a settling chamber in fluid communication between said inlet and outlet;

a separator plate interposed between said settling chamber and said outlet;

said plate having a plurality of irregularly shaped tubes therethrough, each tube forming an unrestricted passage providing fluid communication between said settling chamber and said outlet, whereby foreign objects are trapped by said chamber and plate and prevented from reaching said outlet.

3. The device of claim 2 wherein said tubes have arcuate shaped openings.

4. The device of claim 3 wherein said openings are "C" shaped.

5. The device of claim 2 wherein said housing has wall portions on the settling chamber side of said separator plate closely adjacent said tubes whereby rod shaped foreign objects are prevented from entering said tubes.

6. The device of claim 5 wherein said housing has wall portions on the outlet side of said separator plate spaced closely adjacent said tubes at a greater distance than the spacing between said tubes and said wall portions on the settling chamber side of said separator plate.

7. The device of claim 2 wherein said housing is comprised of an upper housing portion and a lower housing portion which can be detachably joined in a water tight manner.

8. The device of claim 7 wherein said lower housing portion contains said settling chamber and is constructed of a transparent material.

9. The device of claim 7 wherein said upper housing portion is constructed of an elastomeric material and has a lower flange which receives said lower housing and is secured thereto by a circumferential clamping means.

10. The device of claim 2 wherein wash liquid passing through the device must reverse direction after entering said inlet prior to entering said tubes.

11. In an automatic washer having wash liquid drain means, an improved foreign objects trap comprising:

a housing having a single unobstructed inlet and an outlet;

a planar separator plate interposed between said inlet and outlet;

said inlet communicating exclusively with an underside of said separator plate to trap floating objects;

said housing having a selectively removable wall portion positioned below and closely adjacent said separator plate defining a settling chamber;

said separator plate having a plurality of irregularly shaped tubes extending therethrough having passages unrestricted to the flow of lint and wash liquid, but preventing the passage of foreign objects;

whereby, floating objects and heavier than water objects are trapped beneath said separator plate and can be removed upon removal of said wall portion.

* * * * *